FIP7811 XR 4,105,251 SR

United States Patent [19]

Wolff

[11] 4,105,251

[45] Aug. 8, 1978

[54] DISPERSION OF CATALYSTS WITH EXPLOSIVES FOR IN SITU MINING OF CARBONACEOUS MINERALS

[75] Inventor: William F. Wolff, Park Forest, Ill.

[73] Assignee: Standard Oil Company (Indiana), Chicago, Ill.

[21] Appl. No.: 820,100

[22] Filed: Jul. 29, 1977

[51] Int. Cl.[2] ..... E21B 43/24; E21B 43/26; E21C 41/10

[52] U.S. Cl. ..... 299/2; 48/DIG. 6; 166/247; 166/260; 166/265; 166/299; 299/13

[58] Field of Search ..... 166/247, 260, 265, 267, 166/299, 259, 271; 299/2, 13; 102/23; 48/DIG. 6

[56] References Cited

U.S. PATENT DOCUMENTS

| | | | |
|---|---|---|---|
| Re. 21,356 | 2/1940 | Pitzer | 166/299 |
| 3,391,739 | 7/1968 | Venghiattis | 102/23 X |
| 3,630,281 | 12/1971 | Fast | 166/299 X |
| 3,661,423 | 5/1972 | Garrett | 299/2 |
| 3,692,110 | 9/1972 | Grady | 166/247 X |
| 3,713,487 | 1/1973 | Lozanski | 166/299 X |
| 3,722,410 | 3/1973 | Hurst | 102/23 |
| 3,794,116 | 2/1974 | Higgins | 166/247 X |
| 3,951,456 | 4/1976 | Ridley | 299/2 |
| 3,986,556 | 10/1976 | Haynes | 166/260 X |
| 4,043,598 | 8/1977 | French et al. | 299/2 |

*Primary Examiner*—Stephen J. Novosad
*Assistant Examiner*—George A. Suchfield
*Attorney, Agent, or Firm*—Thomas J. Connelly; Arthur G. Gilkes; William T. McClain

[57] ABSTRACT

Disclosed is a process for generating synthetic fuels from carbonaceous minerals such as oil shale and coal by dispersing a catalytic agent by suitable explosive means into carbonaceous deposits. The explosives serve to fracture and rubblize the carbonaceous mineral as well as conveying the catalyst onto and in close proximity to the fractured particles. The catalyst coated particles are then converted, in whole or part, to gaseous and liquid products by conventional processes such as retorting, gasification, hydroretorting, hydrogenation, or the like, wherein this process or part of it is accelerated, decelerated, or otherwise favored by the presence of the catalytic agent. This process is capable of producing an increased yield and/or better quality product since it is possible to maintain greater control over the conversion step.

21 Claims, No Drawings

DISPERSION OF CATALYSTS WITH EXPLOSIVES FOR IN SITU MINING OF CARBONACEOUS MINERALS

BACKGROUND OF THE INVENTION

This invention relates to a method of dispersing a catalytic agent into an underground mineral deposit in order to facilitate the generation of synthetic fuels. More specifically, this invenion relates to the dispersion of catalysts with explosives for in situ mining of carbonaceous minerals.

Although many methods of in situ mining of carbonaceous minerals are patented, none teach the use of a catalyst to enhance recovery. The most general technique for in situ mining, as applied to oil shale, comprises the use of a retorting process. In this process, a retorting zone is formed by mining an access tunnel to or near the retorting area and then removing a portion of the oil shale deposit by conventional mining techniques. About 5 to about 40 percent, preferably about 15 to about 25 percent, of the oil shale in the retorting area is removed to provide void space in the retorting area. The oil shale in the retorting area is then rubblized by well-known mining techniques to provide a retort zone containing rubblized shale. One specific method for forming this underground retort is to undercut the mineral deposit and remove a portion of it in order to provide a cavity. Drill holes are then drilled at various angles and depths into the oil shale surrounding the cavity. Into these drill holes explosives are placed and detonated in order to rubblize the oil shale, preferably forming an area of rubble having a particle size less than 4 feet in diameter. Several of the techniques employed to form the underground cavity and rubblized area are: sublevel stoping, sublevel caving, and room and pillar mining. After the underground retort is formed, the zone of rubblized oil shale is subjected to a retorting process. In such a process, hot gases are passed through the rubblized particles to effectively form and remove liquid hydrocarbons from the oil shale. This is commonly done by passing a retorting gas such as air or air mixed with steam and/or hydrocarbons through the deposit. Most commonly, air is pumped into one end of the retort and a fire or flame front initiated. This flame front is then passed slowly through the rubblized deposit to effect the retorting. Not only is shale oil effectively produced, but also a mixture of off-gases from the retorting is also formed. These gases contain carbon monoxide, nitrogen, ammonia, carbon dioxide, hydrogen sulfide, carbonyl sulfide, and oxides of sulfur and nitrogen. Generally, a mixture of off-gases, water, and shale oil are recovered from the retort. The carbonaceous product is then subject to standard refinery operations to produce a usable product.

Oil shale can be found in various places throughout the world, expecially in the United States in such states as Colorado, Utah and Wyoming. Some especially important deposits can be found in the Green River formation in Piceance Basin, Garfield and Rio Blanco counties, and northwestern Colorado.

The word "catalyst" refers to any substances of which a fractionally small percentage strongly affects the rate of a chemical reaction. For purposes of this invention, the word "catalyst" refers to substances which in relatively small amounts lead to increased yields or rates of formation of desirable products and decreased yields or rates of formation of undesirable products. Though the catalyst itself usually undergoes no chemical change, it is often altered physically by chemically adsorbed molecules of the reactants. Most catalysts accelerate the rate of reaction, but a few retard it. Catalysts may be solid, liquid, or gaseous and their life cycle varies depending on process conditions, after which it must be regenerated or replaced. Catalysts, one of the most important phenomena in nature, is the "loosening" of the chemical bonds of one or more reactants by another substance (catalyst) in such a way that a fractionally small percentage of the catalyst can greatly accelerate the rate of the reaction while remaining unconsumed. Thus one part by volume of catalyst can activate thousands of parts of reactants. A familiar example is the oxidation of iron which is catalyzed by atmospheric water vapor.

Most catalysts are highly specific in their application, for example: powdered nickel is particularly effective for hydrogenation and group VIII metals for the conversion of straight-chain to cyclic hydrocarbons. The activity of a catalyst can be increased by adding promoters which serve to increase the surface area, for example, by increasing porosity. Although catalysts usually increase reactivity, it is possible to catalystically decelerate undesirable reactions by dispersing catalysts (poisons) that would poison naturally occurring catalysts. Another way to decelerate a reaction is to introduce catalysts into the carbonaceous material which would favor competing reactions, thereby minimizing the undesirable kind.

The term "explosive" refers to a chemical compound, usually containing nitrogen, that detonates as a result of shock or heat. Dynamite was the most widely used explosive for blasting purposes until 1955, when it was largely replaced by prills-and-oil and slurry types. The former consist of 94 percent ammonium nitrate prills and 6 percent fuel oils. Slurry blasting agents are based on thickened or gelatinized ammonium nitrate slurries sensitized with TNT (2,4,6-trinitrotoluene), other solid explosives, or aluminum. It is the most efficient commercial blasting agent now in use. Because high explosives vary greatly in their shock sensitivity, it is possible to select an explosive to satisfy any particular need. The range encompasses such explosives as mercury fulminate and nitroglycerin, which are the most sensitive, to TNT and ammonium nitrate which are comparatively difficult to detonate, and usually require an activating device such as blasting caps to set them off.

A number of patents describe methods of in situ mining of carbonaceous deposits, especially oil shale and the most relevant ones are hereinafter described.

Garret, U.S. Pat. No. 3,661,423, is directed to the recovery of carbonaceous values by in situ retorting of rubblized deposits such as oil shale. A limited undercut is made over a large area leaving an overlaying deposit supported by a multiplicity of pillars. The pillars are then removed and the overlaying deposit expanded to fill the void with particles of uniform size, porosity and permeability. Communication is then established with the upper level of the expanded deposit and a high temperature gaseous media which will liquefy or vaporize the carbonaceous values is introduced in a manner which causes the released values to flow downward for collection at the base of the expanded deposit. Convenient media are hot flue gases created by igniting the upper level of the expanded carbonaceous deposit forcing a flow of hot gases downward through the expanded deposit.

Van Poollen, U.S. Pat. No. 3,001,776, is directed to the in situ retorting of oil shale and teaches that the retorts can be formed by well-known mining practices which may include sublevel stoping, shrinkage stopes, sublevel caving or block caving. An access shaft is mined with various drifts so that the retorting area can be worked at a plurality of levels. The overlaying oil shale above a stope is fractured, generally by explosives detonated in blast holes in the overhead deposit. Some of the oil shale is removed to achieve the desired porosity. The retort filled with rubble can be retorted in either the upflow or downflow direction by the injection of air. Ignition can be accomplished by any suitable method such as oxygen used in conjunction with natural gas.

Ellington, U.S. Pat. No. 3,586,377, is directed to a method of in situ recovery of shale oil. The method of obtaining shale oil from a zone of unmined oil shale comprises establishing access means at least two points in said zone, establishing communication between these access means through the zone, fragmenting at least part of the oil shale in the zone in the area of the communication to produce a porous mass of fragmented oil shale, supplying heating means to said fragmented oil shale through one of said access points, to pyrolyze shale oil in the oil shale and collecting said shale oil through the other of said access means.

Prats, U.S. Pat. No. 3,434,757, is directed to a method of in situ recovery of shale oil wherein the rubblized oil shale is created by forming at least two tunnels, exploding the archways between the tunnels and thereby creating a large roof which collapses. Another series of explosives extending radially upward and substantially parallel to the tunnels is detonated to rubblize the overlaying oil shale. Hot fluid is then circulated through the permeable mass of oil shale to release the shale oil.

Ridley, U.S. Pat. No. 3,951,456, discloses an in situ process for recovering carbonaceous values from a subterranean deposit comprising the steps of (a) developing an in situ rubble pile within a retorting chamber of a subterranean carbonaceous deposit having a retorting fluid entrance and retorting fluid exit, said rubble pile being formed by undercutting at about the base of the carbonaceous deposit to remove a predetermined volume of material and form a sloped floor having a high point at the shortest retorting fluid path between the retorting fluid entrance and the floor and the low point at the periphery of the floor and expanding the deposit to form the in situ rubble pile wherein the bulk permeability of the rubble pile increases from the shortest retorting fluid path to the longest retorting fluid path between the retorting fluid entrance and the retorting fluid exit so that the resistance to retorting fluid flow through the rubble pile along all retorting fluid paths is approximately equal; (b) establishing the retorting fluid entrance between the rubble pile and a source of retorting fluid; (c) establishing the retorting fluid exit between the rubble pile and a destination for the retorting fluid, the exit communication with the rubble pile being spaced by at least a portion of the rubble pile from the retorting fluid entrance; (d) retorting the rubble pile to extract the carbonaceous values therefrom, the retorting step including the passage of the retorting fluid through the rubble pile along the retorting fluid paths; and (e) recovering the retorted carbonaceous values.

It is an object of this invention to provide a method of in situ mining of carbonaceous mineral deposits whereby an explosive charge is used to fracture and rubblize the mineral as well as disperse a catalyst.

It is an object of this invention to provide a process for generating synthetic fuels from carbonaceous minerals by employing a catalyst to accelerate, decelerate or otherwise control the step in which hydrocarbon values are recovered from the mineral.

It is further an object of this invention to increase the yield of the recoverable product.

It is still further an object of this invention to obtain a better quality product.

SUMMARY OF THE INVENTION

In accordance with this invention, it has been found that a process for the generation of synthetic fuels from rigid or solid carbonaceous containing minerals, such as oil shale and coal, is possible by using a conventional in situ mining technique in conjunction with dispersing a catalytic agent, by means of explosives, into the mineral. The dispersed catalyst will increase the possibility of recovering a better quality product and/or a higher yield because it is possible to maintain greater control over the conversion step. The most widely used conversion process for in situ mining is retorting but any similar process such as hydroretorting, gasification, or hydrogenation can be used.

The process disclosed by this invention comprises the steps of using an in situ mining technique, such as room and pillar, sublevel stoping, sublevel caving, double entry system, and the like, but preferably sublevel caving to form an underground cavity, preferably tunnel shaped, into the mineral deposit. The cavity can be formed next to or in close proximity to the carbonaceous mineral but the optimum result is obtained when the cavity is formed within the mineral formation itself. After the underground cavity is mined, numerous holes are drilled into the periphery of the cavity at various angles and depth and filled with explosives. Usually the holes are closed with a packing material called "stemming" but this is not always necessary. Stemming is used to enable explosives to develop their full power, to minimize the amount of poisonous gases which may be evolved and to decrease the cost. Clay, sand and foam make the best stemming but broken rock, screening or ore dust work fairly well.

Use of this invention is feasible with either nuclear or non-nuclear explosives but because of the strict safety standards imposed by most government agencies concerning the use of nuclear explosives, one may be allowed to utilize only the non-nuclear type explosives. In the non-nuclear catagory there are several commercially available industrial or mining explosives which can be used. The most logical choices are dynamite, nitroglycerine, TNT, ammonium nitrate, and liquid oxygen explosives. The preferred explosives are ammonium nitrate slurries for they are the most efficient commercial blasting agent now in use. However, ammonium nitrate like TNT is comparatively difficult to detonate and therefore it is necessary to use a blasting cap or a similar activating device to set it off. In a way, this is beneficial for it increases the safety factor and insures that an explosive will not go off prematurely. Mining Engineer's Handbook, Third Edition, Volume 1, Section 4, published by John Wiley & Sons, Inc., New York, explains in detail the chemistry of explosives, peak blast pressure, influence of loading density, history of shaped-charge phenomena, explosive factors in cavity effect, as well as charging and firing characteristics.

Section 4 of this text is incorporated by reference and made a part hereof.

It should be noted that this invention teaches that a catalytic agent is combined with an explosive and dispersed when the charge is detonated. The catalyst can be either in the solid, liquid or gaseous state and is combined with the explosive either by being chemically or physically mixed with it, or by positioning it in close proximity to the charge, for example, as in the stemming. The particular method of affixing or combining the catalyst to the explosive will depend upon the properties of each and their physical or chemical compatibility. One feasible way of combining the two is to use a solid powdered catalyst which is physically mixed into the explosive slurry. This will assure a more uniform dispersal of the catalyst throughout the charge and will yield a more homogeneous dispersion of the catalyst once the charge explodes. The prospects of having greater control over the retorting step is enhanced when the catalyst is evenly dispersed. Although uniform dispersal throughout the entire retorting zone is highly unlikely, it is still possible to obtain the expected results when the catalyst is scattered throughout a majority of the deposit. The kind of catalyst which can be used in this process also varies just like the kinds of explosives which can be used. In selecting a catalyst, one should consider a number of factors: first, what activity does the catalyst have, that is, the ease with which it catalyzes a given reaction; second, what selectivity is required—its ability, for example, to promote the hydrogenation of one functional group in preference to any other reactive entities which may be present; third, is the cost justifiable; fourth, is the catalyst commercially available; fifth, is the catalyst volatile; sixth, diffusibility—its ability to be scattered or transmitted by the explosive; seventh, its compatibility with the explosive; and eighth, stability. Other factors such as: temperature and pressure variables, resistance to poisoning, ability to react with a solvent or promoter, and its release of noxious gas should be taken into consideration.

Suitable catalysts for the conversion of coal and gaseous products from coal pyrolysis or combustion can be found, for example, in H. H. Lowry's "Chemistry of Coal Utilization," Volume II, page 921–1868, published by John Wiley & Sons, Inc., N.Y., N.Y., copyrighted 1945, which is incorporated by reference and made a part hereof. This text includes a description of catalysts suitable i.e.: for ammonia decomposition, for combustion of coal, for combustion of coke, for conversion of organic sulfur in gas to hydrogen sulfide, for conversion of organic sulfur in gas to sulfur dioxide, for dry purification of gas, for hydrogenetion of coal, for oxidation of carbon monoxide, for oxidation of methane, for oxidation of organic sulfur in gas, for steam-carbon reaction, for synthesis of hydrocarbons, and for water-gas reaction.

Many of the catalysts useful with coal can also be used in the processing of oil shale. In addition, a catalyst having combustion inhibitor properties, such as salts of phosphoric and boric acids can also be used. For oil shale, the kind of catalyst utilized will depend upon the particular product one wishes to recover, since a product will vary in quality and make-up, such as sulfur, nitrogen and metals content, depending upon the type of catalyst used. Possible catalysts include lime, sodium carbonate and other substances that have been shown to be effective as anti-coking agents. If one wishes to promote combustion within the oil shale, then alkali sulfides as well as basic potassium salts would prove useful. For an inexpensive operation, one would exploit inexpensive heterogeneous catalysts such as spent cracking catalyst or catalysts prepared from minerals available on the excavation site. For desulfurization, one might well employ nickel or the platinum metals although these would be relatively expensive and perhaps economically unfeasible for all mining operations. Likewise, cobalt molybdenum, nickel molybdenum, iron chloride and zinc chloride, although expensive, could be used for deposition in limited regions where they can be used to best advantage for conversion of the organic shale products. Other kinds of substances which are capable of catalyzing mineral transformations or as active desulfurizing agents can also be used. Some examples are strong acids, such as sulfuric acid and hydrofluoric acid, or strong bases such as sodium hydroxide or potassium hydroxide. However, it must be recognized that any catalyst that will aid cracking, hydrogenation or reforming can be used.

Once the desired explosive and catalyst are selected, united, and placed in the drill holes, the deposit is ready for firing. The size of the area which can be rubblized will depend upon the makeup of the carbonaceous mineral and the size and placement of the charge. Detonation of the charge can follow any conventional in situ mining technique which will fracture and rubblize the mineral. In a normal sublevel stoping operation up to 120,000 square feet of mineral can be blasted at a time. It is preferred that a relatively uniform particle size results but for all practical purposes this is impossible. However, the method of this invention will be operable when the particle size is less than four feet in diameter. Better results are possible when the particle size is smaller because more surface area is exposed for contact with the catalyst. When the explosive is detonated the catalyst is dispersed and again a uniform dispersion is preferred. In the majority of the cases this will be impossible due to the structural formation of the mineral, however, a non-uniformly dispersed catalyst will do a sufficient job provided the catalyst comes into contact with a major portion of the mineral deposit. Furthermore, a non-uniform distribution would be advantageous if, for example, one needed a catalytic attack on a segment of large blocks of oil shale in order to fracture or disintegrate them.

According to this invention, typical catalysts chosen for use will function as heterogeneous catalysts. Some substances, however, such as sulfuric acid, may function as homogeneous catalysts.

This invention also contemplates the possibility of using a solvent along with the catalyst to aid in the recovery process. A solvent can be used to facilitate the dispersion of a catalyst or as an aid in the liquefaction of, and recovery of certain desirable products from the carbonaceous material.

After the catalyst is dispersed, the rubblized particles are subjected to a conversion process whereby the hydrocarbons are extracted from the mineral. The most common conversion processes known today, which are applicable to out method, are: retorting, gasification, hydroretorting and hydrogenation. However, any similar process which performs a like function can be used. The retorting process appears to be the most favorable choice and has been taught in prior patents such as those listed earlier in the background section of this application. In the typical retorting phase, hot gases, such as air or air mixed with steam, are pumped into one end of the retort and a fire or flame front initiated. This flame front passes slowly through the rubblized deposit to effect the retorting. The catalyst serves to accelerate, decelerate, or otherwise promote the retorting process. By selecting a particular catalyst it is possible for one to control the retorting step to the point where it is possible to adjust yield, quality product and/or rate of recovery. As the flame front descends through the rubblized deposit it frees the hydrocarbons contained in the mineral. These hydrocarbons exist in the liquid and gaseous state and gradually descend to the bottom of the retort usually ahead of the flame front. Upon reaching the bottom, they are collected and transported to the surface where they are processed by conventional refinery operations. Once the product is recovered, it is beneficial to remove any existing catalyst so that it may be reused. This recovery step enables a relatively expensive catalyst to be used to facilitate the conversion phase without putting an enormous financial burden upon the entire operation. The recovered catalyst may then be used in another conversion step immediately or be subjected to a regeneration step before reuse. Regeneration of the catalyst is simply the process of restoring it to a useful state. It should be noted, that it is desirable to remove the catalyst from the recoverable product before this product is exposed to the refinery operation.

EXAMPLE 1

A laboratory experiment conducted by applicant shows the dispersion of a catalyst by explosives. Although the conversion step was conducted under a constant pressure of 500 psig (a pressure value which may be unattainable underground except at great depth), this experiment does show that a catalyst coated mineral will provide an increased yield.

In this example, 0.539g 20–60 mesh Pittsburgh seam coal was charged to a 10 ml Hoke pressure vessel and treated with an explosion-generated catalyst. The explosive, nitrogen iodide, was prepared by adding iodine crystals to 28–30% ammonium hydroxide, crushing the crystals and allowing the mixture to stand overnight. A portion of the dark solid formed in this manner was removed with a weighed micro-spatula and allowed to dry in the air for about four and a half hours. The dry solid weighed 0.0110g. The spatula was then inserted into the bed of coal to obtain a vigorous explosion that blew much of the coal out of the top. The coal captured by a retaining system around the Hoke vessel was then returned to the vessel to obtain a toal of 0.4838g coal plus explosion-generated catalyst in the vessel. Then, 1.03g tetralin was added, the vessel was flushed with hydrogen and pressured to 500 psig with hydrogen, and the vessel was heated for 1 hour at 745°–750° F in a fluidized sand bath, using a back-pressure regulator to maintain a constant pressure of 500 psig. The vessel and contents were then weighed to determine the weight loss during the run, 0.03g. The products in the Hoke vessel were then filtered with repeated toluene washings to obtain 0.2211g toluene-insoluble solids. The filtrate was then evaporated on a steam bath with nitrogen blowing to obtain 0.34g brown resinous solid. Thus, as measured by weight loss, coal treated in accord with my invention gave 53–54% toluene-soluble products.

By way of comparison with my process, 0.5005g of the 20–60 mesh Pittsburgh seam coal and 1.05g tetralin were heated under a hydrogen atmosphere under the same conditions described in the preceding example, but without the addition and explosion of nitrogen iodide. In this run the weight loss was 0.06g; 0.3318g toluene-insoluble products were obtained; and only 0.14g residue was obtained by evaporation of the filtrate. As measured by weight loss, only 34% of the coal was converted into toluene-soluble products. Comparison of this result with the above results shows the coal prepared with the catalyst gave approximately 50% more toluene-soluble products than the untreated coal.

I claim:

1. A process for the generation of synthetic fuels from rigid or solid carbonaceous mineral deposits, such as oil shale and coal, by using an in situ mining technique to promote the conversion of hydrocarbons to a more desirable product, which comprises: using explosives to fracture and rubblize the mineral and disperse a catalyst into said mineral in such a manner that the subsequent conversion of the catalyst coated particles to recoverable product can be better controlled.

2. The process as described in claim 1 wherein the explosives uniformily disperse the catalyst.

3. The process as described in claim 1 wherein nuclear explosives are used.

4. The process as described in claim 1 wherein nonnuclear explosives are used.

5. The process as described in claim 1 wherein an ammonium nitrate slurry is used as the explosive.

6. The process as described in claim 1 wherein the in situ mining technique is sublevel stoping.

7. The process as described in claim 1 wherein the in situ mining technique is sublevel caving.

8. The process as described in claim 1 wherein retorting is used to convert the catalyst coated particles to recoverable product.

9. The process as described in claim 1 wherein hydroretorting is used to convert the catalyst coated particles to recoverable product.

10. The process as described in claim 1 wherein gasification is used to convert the catalyst coated particles to recoverable product.

11. The process as described in claim 1 wherein hydrogenation is used to convert the catalyst coated particles to recoverable product.

12. The process as described in claim 1 wherein the catalyst is heterogeneous.

13. The process as described in claim 1 wherein the catalyst is separated and removed from the recoverable product.

14. The process as described in claim 1 wherein a solvent is dispersed along with the catalyst to faciliate recovery.

15. The process as described in claim 1 wherein the explosive and catalyst are physically combined.

16. The process as described in claim 1 wherein the explosive and catalyst are chemically combined.

17. The process as described in claim 1 wherein the explosive and catalyst are positioned in close proximity to one another.

18. The process as described in claim 17 wherein the catalyst is combined with the stemming.

19. A process for the generation of synthetic fuels from solid carbonaceous mineral deposits, such as oil shale and coal, which uses an explosive to fracture and rubblize the carbonaceous deposit and to disperse a catalyst into said rubblized deposit in order to increase the yield of oil, to increase the rate of oil production and/or to improve the quality of the oil produced, which comprises the steps of:

(a) using a conventional mining technique to produce an underground cavity within the carbonaceous mineral deposit;

(b) drilling holes into the surrounding surface of said cavity;

(c) combining a catalytic agent with said explosives and inserting both into said drill holes;

(d) detonating said explosives so as to facture and rubblize the carbonaceous mineral and to disperse the catalysts;

(e) practicing in situ retorting of the rubblized carbonaceous mineral in order to convert the catalyst coated particles of oil shale to a recoverable product;

(f) recovering the product; and (g) removing said catalyst from the recoverable product.

20. The process as described in claim 19 wherein a solvent is added to the catalytic agent.

21. A process for the generation of synthetic fuels from a carbonaceous mineral deposit such as oil shale and coal by using an in situ mining technique, which comprises: employing a prills-and-oil type explosive to rubblize and disperse a catalyst into the carbonaceous deposit so that the rubblized catalyst coated particles can be converted to a recoverable product by means of retorting and the catalyst can be recovered from the product for reuse.

* * * * *

UNITED STATES PATENT OFFICE

CERTIFICATE OF CORRECTION

Patent No. 4,105,251 Dated August 8, 1978

Inventor(s) William F. Wolff

It is certified that error appears in the above-identified patent and that said Letters Patent are hereby corrected as shown below:

| COLUMN | Patent Line | |
|---|---|---|
| 2 | 7 | "Catalysts" should be Catalysis |
| 2 | 24 | "catalystically" should be catalytically |
| *5 | 53 | "hydrogenetion" should be hydrogenation |
| *8 | 50 | "faciliate" should be facilitate |
| 9 | 9 | "facture" should be fracture |

Signed and Sealed this

Tenth Day of April 1979

[SEAL]

Attest:

RUTH C. MASON
Attesting Officer

DONALD W. BANNER
Commissioner of Patents and Trademarks